US011454025B2

(12) United States Patent
Webb et al.

(10) Patent No.: US 11,454,025 B2
(45) Date of Patent: Sep. 27, 2022

(54) METAL STUD

(71) Applicant: U.S. CHEMICAL STORAGE, LLC, Wilkesboro, NC (US)

(72) Inventors: Jered M Webb, Cleveland, NC (US); Anthony D. Cornia, North Wilkesboro, NC (US)

(73) Assignee: U.S. CHEMICAL STORAGE, LLC, Wilkesboro, NC (US)

( * ) Notice: Subject to any disclaimer, the term of this patent is extended or adjusted under 35 U.S.C. 154(b) by 0 days.

(21) Appl. No.: 16/580,188

(22) Filed: Sep. 24, 2019

(65) Prior Publication Data

US 2020/0131767 A1 Apr. 30, 2020

Related U.S. Application Data

(60) Provisional application No. 62/752,388, filed on Oct. 30, 2018.

(51) Int. Cl.

| | |
|---|---|
| ***E04C 3/06*** | (2006.01) |
| ***E04B 1/24*** | (2006.01) |
| ***E04B 2/60*** | (2006.01) |
| ***E04B 2/78*** | (2006.01) |
| ***E04B 1/08*** | (2006.01) |
| ***E04C 3/04*** | (2006.01) |

(52) U.S. Cl.

CPC ..... *E04C 3/06* (2013.01); *E04B 1/24* (2013.01); *E04B 2/60* (2013.01); *E04B 2/789* (2013.01); *E04B 1/08* (2013.01); *E04B 2001/2466* (2013.01); *E04C 2003/0473* (2013.01)

(58) Field of Classification Search

CPC . E04B 2/60; E04B 2/789; E04B 2/706; E04B 2/7453; E04C 2003/0473

See application file for complete search history.

(56) References Cited

U.S. PATENT DOCUMENTS

| | | | | | |
|---|---|---|---|---|---|
| 4,641,469 | A * | 2/1987 | Wood | E04C 2/384 | 52/309.12 |
| 4,850,169 | A * | 7/1989 | Burkstrand | E04B 1/5818 | 52/241 |
| 4,951,436 | A * | 8/1990 | Burkstrand | E04B 1/5818 | 52/238.1 |
| 5,155,962 | A * | 10/1992 | Burkstrand | E04B 1/5818 | 52/241 |
| 5,287,675 | A * | 2/1994 | McGee | E04B 2/60 | 52/265 |
| 5,893,248 | A * | 4/1999 | Beliveau | E04F 13/0803 | 52/309.7 |
| 6,360,510 | B1 * | 3/2002 | Woodrum | E04B 2/62 | 52/36.2 |
| 6,408,594 | B1 * | 6/2002 | Porter | E04B 7/22 | 52/220.1 |
| 6,892,507 | B1 * | 5/2005 | Pease | E04B 1/80 | 52/407.3 |
| 7,621,096 | B2 * | 11/2009 | Ellis | E04B 2/7457 | 52/489.1 |
| 7,849,640 | B2 * | 12/2010 | Rice | E04B 2/7457 | 33/483 |

(Continued)

*Primary Examiner* — Andrew J Triggs
(74) *Attorney, Agent, or Firm* — Dorsey & Whitney LLP

(57) ABSTRACT

A steel wall stud has a rear wall, two parallel side walls, each side wall having a front end wall that projects away from interior cavity formed by the rear and side walls.

17 Claims, 3 Drawing Sheets

(56) References Cited

U.S. PATENT DOCUMENTS

| | | | | |
|---|---|---|---|---|
| 7,882,676 | B2 * | 2/2011 | Ellis | E04B 2/7457 52/489.1 |
| 8,109,055 | B2 * | 2/2012 | Miller | E04B 1/14 52/220.7 |
| 8,109,058 | B2 * | 2/2012 | Miller | E04B 1/14 52/309.7 |
| 8,151,539 | B2 * | 4/2012 | Grinsted | E04C 2/205 52/220.2 |
| 8,234,833 | B2 * | 8/2012 | Miller | E04B 7/22 52/220.7 |
| 8,910,439 | B2 * | 12/2014 | Ingjaldsdottir | E04B 1/3483 52/309.16 |
| 8,978,325 | B2 * | 3/2015 | Lewis | E04B 1/7675 52/309.7 |
| 9,140,008 | B2 * | 9/2015 | Beaty | E06B 1/34 |
| 10,533,319 | B2 * | 1/2020 | Lake | E04C 3/04 |
| 2005/0102969 | A1 * | 5/2005 | Burg | H02G 3/386 52/782.1 |
| 2006/0117689 | A1 * | 6/2006 | Onken | E04C 2/22 52/309.7 |
| 2008/0289275 | A1 * | 11/2008 | Ellis | E04B 2/7457 52/288.1 |
| 2010/0146903 | A1 * | 6/2010 | Ellis | E04B 2/7457 52/696 |
| 2014/0182231 | A1 * | 7/2014 | Sucato | E04C 3/08 52/633 |
| 2015/0052840 | A1 * | 2/2015 | Beaty | E04B 2/16 52/483.1 |
| 2018/0058067 | A1 * | 3/2018 | Lake | E04B 2/62 |
| 2020/0131767 | A1 * | 4/2020 | Webb | E04C 3/06 |

* cited by examiner

METAL STUD

RELATED APPLICATIONS

This application claims the benefit of U.S. Application Ser. No. 62/752,388 filed on Oct. 30, 2019 and which, is incorporated herein by reference.

FIELD OF THE INVENTION

This invention is directed towards a metal wall stud suitable for use in the construction of prefabricated metal buildings, including both fire rated and non-fire rated wall construction. It is a more particular aspect of the invention to provide for an improved "C"-shaped stud member that imparts greater structural strength and has a unique shape that allows for placement of fewer studs within a building and without sacrificing the performance characteristics of the building.

This invention is further directed to a prefabricated wall assembly using metal wall studs.

BACKGROUND OF THE INVENTION

This invention relates to wall studs and wall assemblies using the wall studs that are used in prefabricated metal structures. Typically, wall studs in metal prefabricated buildings are built with the studs placed on 12 inch to 24 inch centers using C-shaped studs. While traditional "C"-shaped studs are adequate for some construction purposes, there is room for variation and improvement within the art.

SUMMARY OF THE INVENTION

It is one aspect of at least one of the present embodiments to provide for a wall stud that offers at least a comparable strength over a traditional C-channel stud and provides a wall constructed using less total materials in the studs.

It is a further aspect of at least one of the present embodiments to provide for a flange having a wider surface area than a conventional C-flange or tube, the wider surface area providing a greater surface area for connecting interior sheeting, which in turn provides for a larger connection area and greater strength.

It is a further aspect of at least one of the present embodiments to provide for a wall stud having a greater in-plane shear resistance such that it is able to resist imposed lateral loads or seismic loads with less need for additional sheathing.

It is a further aspect of at least one of the present embodiments to provide for a metal stud having a 14-gauge thickness having a channel depth of about 4 inches, a width of about 3.63 inches, and a flange length of about 2.07 inches.

It is a further aspect of at least one of the present embodiments to provide a wall stud comprising: a 14-gauge thickness plus or minus 20% having a channel depth of 4 inches plus or minus 12%, a 3.63 inch width plus or minus 20%, and a flange length of 2.07 inches plus or minus 20%.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that, the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The term "about" means the stated value plus or minus 10 percent unless another value range is given.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
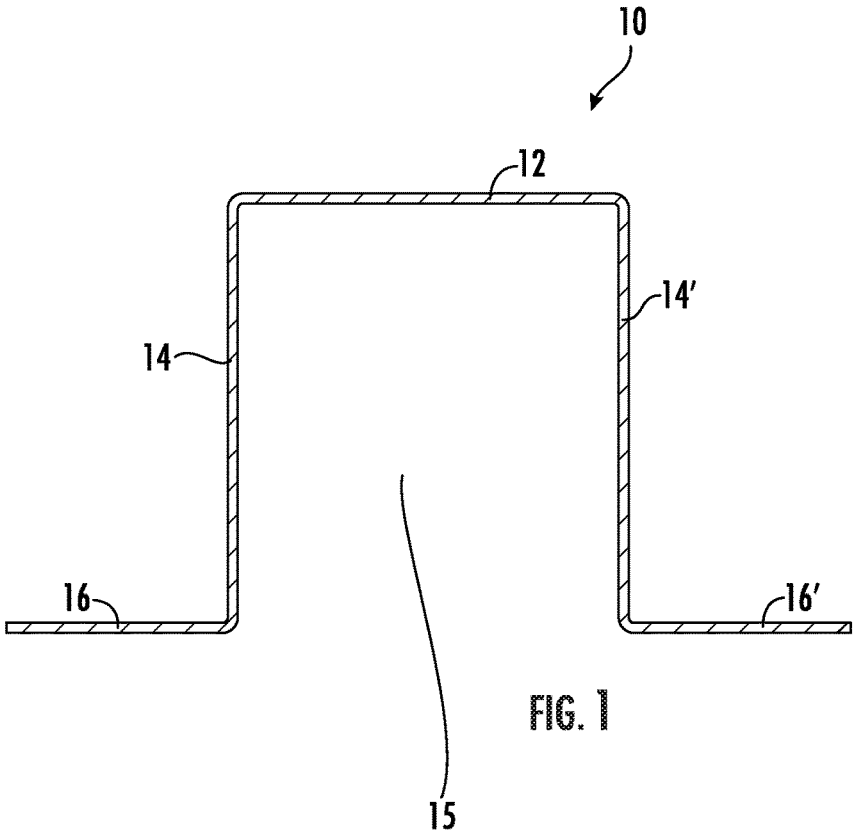
FIG. 1 sets forth a top view of a wall stud in accordance with the present invention.
Figure 2:
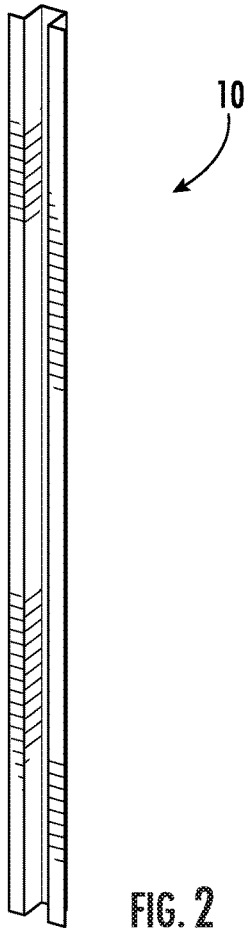
FIG. 2 sets forth a perspective view of the wall stud seen in FIG. 1.
Figure 3:
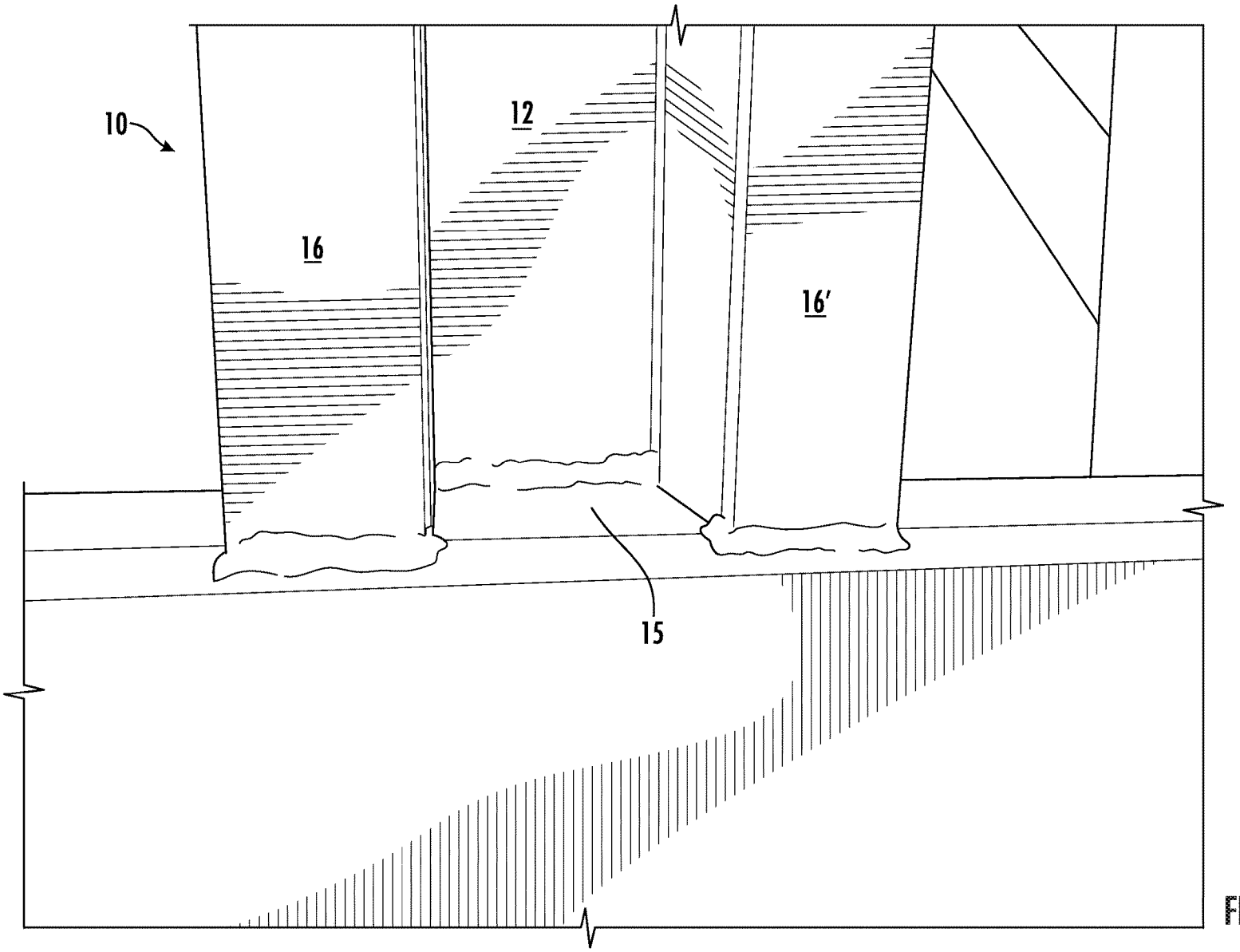
FIG. 3 is a perspective view of a bottom section of a wall stud connected to a frame member.

As best seen in reference to FIG. 1, a wall stud 10 is provided have a rear wall 12, two parallel side walls 14 and 14' which project in a forward direction and are connected to the rear wall at about a 90-degree angle. A cavity 15 is defined between the two side walls and the attached rear wall. The front end of each side wall is connected to a respective front wall member 16 and 16', walls 16 and 16' being substantially parallel to rear wall 12 and which project away from the interior cavity 15.

Each side wall 14 and 14' has a length of about 4 inches. The rear wall 12 has a length of about 3.63 inches, and each front wall has a length of about 2.07 inches. The flange material is preferably one of galvanized steel and has a thickness of about 0.0713 inches (14 gauge) and a cross sectional area of about 1.09 $in^2$.

The present invention provides for a wall stud which is tailored specifically for modular units. The center width and the flange length and respective dimension ratios offer unique advantages. The stud of the present invention has several advantages over conventional C-shaped studs. One advantage is that the present wall stud channel will save on total materials over the C-Channel and is comparable to a HSS tube. The cross section of the wall stud yields a 1.09 $in^2$ surface area. A typical 14 ga C-Channel is 0.62 $in^2$ and the HSS tube is 1.07 $in^2$. These areas (with the indicated stud spacing and a typical 8 ft tall wall) yield a per square foot metal volume described below.

The stud according to the present invention in a typical 8 ft tall wall would be @ 24" o.c., 96 in tall=6.54 $in^3/ft^2$ A sample 400S200-68 C-Channel @ 12" o.c., 96" tall=7.44 $in^3/ft^2$ would utilize 12% more material than the present wall stud. A HSS3x2x.125 Tube @24" o.c., 96" tall=6.42 $in^3/ft^2$ is 2% less than the improved wall stud.

The present wall stud, when compared to the HSS tube, has a surface area from the wall stud flange/web which is much wider. The interior of the wall has 3.63" of connection surface width contacting the interior sheathing and two 2.07" flanges in close proximity for the exterior sheathing. This creates a larger connection area and also allows for a tighter horizontal fastener spacing for high wind applications.

Additionally, the wall stud can provide in-plane shear resistance. C-Channels do not have any "shearwall" or "moment frame" capacity integrated into their design. In some cases, the wall stud itself will be able to resist imposed lateral MWFRS or Seismic loads (SDC 'C' or less) without a shearwall sheathing analysis. The sheathing would still be necessary for many reasons, but fastener spacing and the amount of material used may remain unaltered by the shear load.

Figure 4:
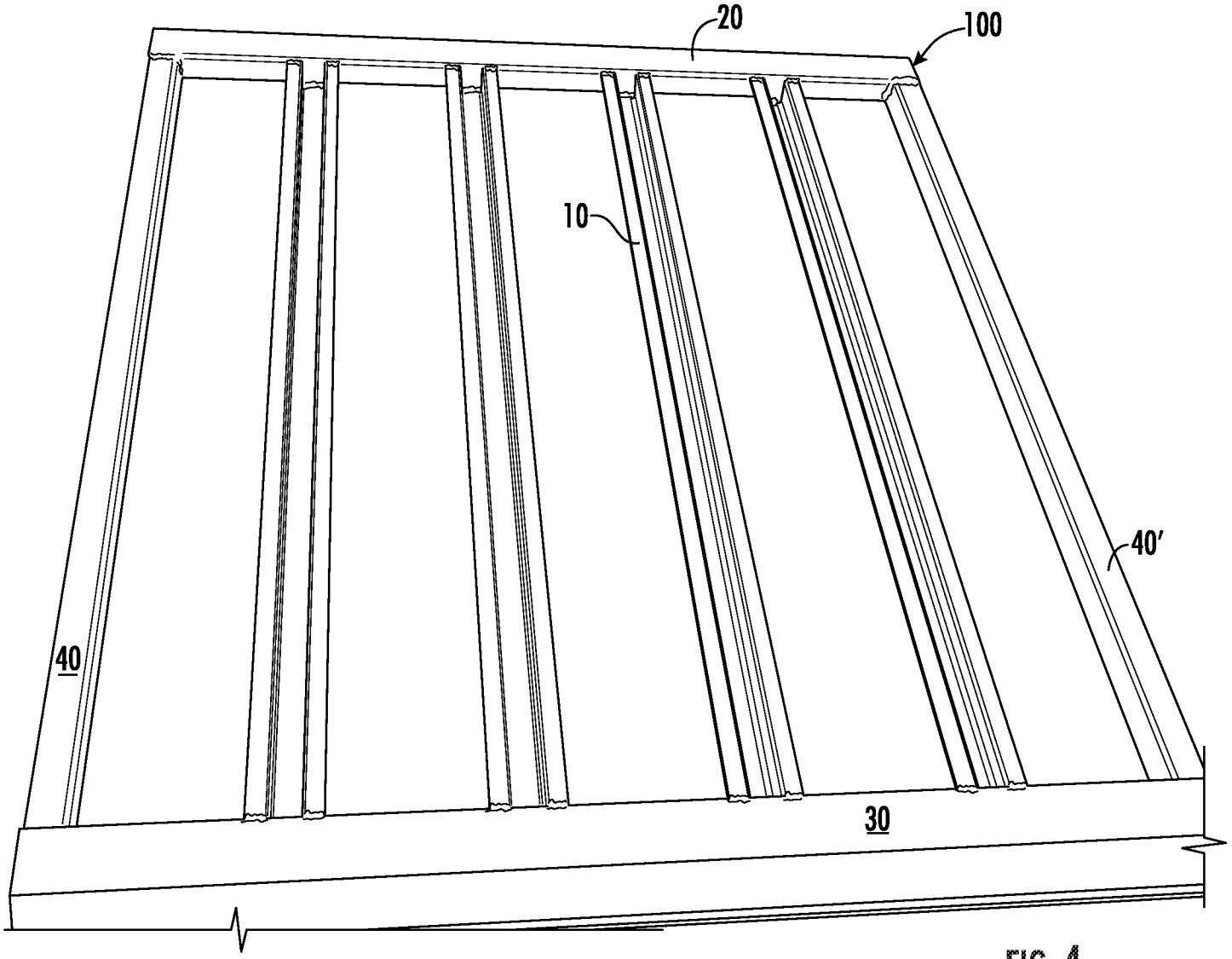
FIG. 4 is a perspective view of a wall assembly in which a wall panel is constructed using a plurality of wall studs within a frame to form a wall assembly.

As seen in reference to FIG. 4, the stud 10 can be used to provide for panels 100 in which the studs 10 are attached to an upper horizontal beam 20 and a lower horizontal beam 30. On either side of the panel 100 is a respective side frame member 40 and 40'. Preferable the spacing between adjacent studs is about 24 inches. As is know in the art, front and rear facing materials of gypsum with an outer layer of galvanized steel sheathing may be used. Additionally, the cavity 15 may have a layer of mineral wool placed therein.

Although preferred embodiments of the invention have been described using specific terms, devices, and methods, such description is for illustrative purposes only. The words used are words of description rather than of limitation. It, is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained therein.

That which is claimed:

1. A wall panel assembly comprising:

a horizontal top beam;

a horizontal bottom beam;

a pair of parallel side frames connected to respective free ends of the horizontal top beam and the horizontal bottom beam; and an interior portion of the wall panel assembly having a plurality of metal wall studs consisting of a singular series of metal wall studs coplanar with each other, the plurality of metal wall studs configured to abut an interior wall sheathing and position within close proximity to an exterior wall sheathing, each metal wall stud of the plurality of metal wall studs comprising:

a rear wall configured to abut the interior wall sheathing;

two parallel side walls which project in a forward direction and are connected to the rear wall at about a 90-degree angle;

a cavity defined between the two side walls and the rear wall; and a flange comprising a front wall member connected to a front end of each parallel side wall, the flange being positioned within close proximity to the exterior wall sheathing, the flange being substantially parallel to the rear wall, and the flange projecting away from the cavity.

2. The wall panel assembly of claim 1, wherein the wall panel assembly is fire rated.

3. A wall panel assembly consisting of:

a horizontal top beam;

a horizontal bottom beam;

a pair of parallel side frames connected to respective free ends of the horizontal top beam and the horizontal bottom beam; and an interior portion of the wall panel assembly having a plurality of metal wall studs consisting of a singular series of metal wall studs coplanar with each other, the plurality of metal wall studs configured to abut an interior wall sheathing and position within close proximity to an exterior wall sheathing, each metal wall stud of the plurality of metal wall studs consisting of:

a rear wall configured to abut the interior wall sheathing;

two parallel side walls which project in a forward direction and are connected to the rear wall at about a 90-degree angle;

a cavity defined between the two side walls and the rear wall; and a flange comprising a front wall member connected to a front end of each parallel side wall, the flange being positioned within close proximity to the exterior wall sheathing, the flange being substantially parallel to the rear wall, and the flange projecting away from the cavity.

4. The wall panel assembly of claim 3, wherein the flange is attached to the exterior wall sheathing via one or more fasteners.

5. The wall panel assembly of claim 3, wherein each front wall member of the flange is connected to the exterior wall sheathing via the one or more fasteners.

6. The wall panel assembly of claim 3, wherein the flange is connected to the exterior wall sheathing at spatial intervals less than a stud spacing interval between the plurality of metal wall studs.

7. The wall panel assembly of claim 3, wherein the plurality of metal wall studs are spatially positioned at about 24 inch centers between the pair of parallel side frames.

8. The wall panel assembly of claim 3, wherein the flange is oriented towards the exterior wall sheathing.

9. The wall panel assembly of claim 3, wherein the flange comprises a galvanized steel material.

10. A wall panel assembly comprising:

a horizontal top beam;

a horizontal bottom beam;

a pair of parallel side frames connected to respective free ends of the horizontal top beam and the horizontal bottom beam;

an interior wall sheathing and an exterior wall sheathing defining an interior portion of the wall panel assembly, the interior portion comprising:

a plurality of steel wall studs consisting of a singular series of steel wall studs coplanar with each other, wherein:

the plurality of steel wall studs are configured to abut the interior wall sheathing and position within close proximity to the exterior wall sheathing;

the plurality steel wall studs are positioned between the pair of parallel side frames; and each steel wall stud of the plurality of steel wall studs comprises:

a rear wall configured to abut the interior wall sheathing;

two parallel side walls which project in a forward direction and are connected to the rear wall at about a 90-degree angle;

a cavity defined between the two parallel side walls and the rear wall;

wool disposed within the cavity; and a flange comprising a front wall member connected to each parallel side wall, wherein:

the flange is positioned within close proximity to the exterior wall sheathing;

the flange is connected to the exterior wall sheathing via one or more fasteners;

the flange is substantially parallel to the rear wall; and the flange projects away from the cavity.

11. The wall panel assembly of claim 10, wherein each front wall member of the flange is connected to the exterior wall sheathing via the one or more fasteners.

12. The wall panel assembly of claim 10, wherein the flange is connected to the exterior wall sheathing at spatial intervals less than a stud spacing interval between the plurality of steel wall studs.

13. The wall panel assembly of claim 10, wherein the plurality of steel wall studs are spatially positioned at about 24 inch centers between the pair of parallel side frames.

14. The wall panel assembly of claim 10, wherein the flange is oriented towards the exterior wall sheathing.

15. The wall panel assembly of claim 10, wherein the flange comprises a galvanized steel material.

16. The wall panel assembly of claim 10, wherein the exterior wall sheathing comprises:

at least one layer of gypsum sheathing; and an outer layer of galvanized steel sheathing.

17. The wall panel assembly of claim 10, wherein the plurality of steel wall studs provides in-plane shear resistance.

* * * * *